United States Patent [19]

Meershoek

[11] Patent Number: 4,789,806

[45] Date of Patent: Dec. 6, 1988

[54] CATHODE RAY TUBE DEFLECTION UNIT COMPRISING MEANS FOR COMPENSATING FOR MISALIGNMENT OF THE LINE AND FIELD DEFLECTION COIL SYSTEMS

[75] Inventor: Hans Meershoek, Eindhoven, Netherlands

[73] Assignee: U.S. Philips Corp., New York, N.Y.

[21] Appl. No.: 29,842

[22] Filed: Mar. 24, 1987

[30] Foreign Application Priority Data

Apr. 2, 1986 [NL] Netherlands ..... 8600833

[51] Int. Cl.[4] ..... H01J 29/76

[52] U.S. Cl. ..... 313/440; 335/211; 335/213

[58] Field of Search ..... 313/440; 335/211, 213, 335/214

[56] References Cited

U.S. PATENT DOCUMENTS 4,229,720 10/1980 Heijnemans et al. ..... 335/213

4,654,615 3/1987 McGlashan ..... 335/211

*Primary Examiner*—David K. Moore

*Assistant Examiner*—K. Wieder

*Attorney, Agent, or Firm*—Thomas A. Briody; Leroy Eason

[57] ABSTRACT

A cathode ray tube deflection unit comprising a field coil system with two diametrically opposite field deflection coils and a line coil system with two diametrically opposite line deflection coils. Each coil has a front end segment (15, 18), a rear-end segment (16, 19) and conductors (17, 20) extending between such segments. In order to prevent rotation of the horizontal lines of the raster on the CRT display screen with respect to the horizontal axis, which rotation is caused by tolerance errors in alignment of the two coil systems, a pair of plate-shaped parts (21, 21') of soft magnetic material are arranged respectively extending across the front end segment (15, 15') of the respective line deflection coils (11, 11') in positions coinciding with diametrically opposite vertices of a rectangle whose diagnonals intersect substantially on the longitudinal axis of the deflection unit, and at which positions a portion of the front end segment of a line deflection coil overlaps a portion of the front end segment of a field deflection coil.

2 Claims, 2 Drawing Sheets

CATHODE RAY TUBE DEFLECTION UNIT COMPRISING MEANS FOR COMPENSATING FOR MISALIGNMENT OF THE LINE AND FIELD DEFLECTION COIL SYSTEMS

BACKGROUND OF THE INVENTION

1. Field of the Invention

The invention relates to a deflection unit for a cathode ray tube having a neck portion and a display screen, the deflection unit being arranged between the neck portion and the display screen and around the flared portion of the tube connecting the neck portion and the display screen, the deflection unit comprising a field coil system and a line coil system for deflecting an electron beam produced in the neck portion in mutually orthogonal directions; the field coil system having a pair of diametrically opposite saddle type field deflection coils located on either side of a vertical axis and the line coil system having a pair of diametrically opposite saddle type line deflection coils located on either side of a horizontal axis extending at right angles to the vertical axis; each coil having a front end segment, a rear end segment and conductors extending between the front and the rear end segments.

2. Description of the Related Art

A deflection unit of the above described type is known from U.S. Pat. No. 4,229,720, issued Oct. 21, 1980, which corresponds to Netherlands patent specification No. 170,573 corresponding to U.S. Pat. No. 4,229,720, issued Oct. 21, 1988 and from the magazine "Funkschau" No. 23, 1980, pages 88–92 published in West Germany by Fanzis-Verlag GmbH published in West Germany.

In a deflection unit of this type the line deflection coils which generate a vertical magnetic field for the horizontal deflection must be arranged at right angles to the field deflection coils which generate a horizontal magnetic field for the vertical deflection. In the case of mutually orthogonal positions the magnetic coupling between the coil pairs is equal to zero so that no voltage is induced in the field deflection coils as a result of the magnetic field generated by the line deflection coils.

However, in practice it may occur that due to mechanical inaccuracies and/or manufacturing tolerances of the components during assembly the line deflection coils are not arranged exactly at right angles to the field deflection coils. In such a case a voltage will be induced in the field deflection coil as a result of the magnetic field of the line deflection coils. Detrimental consequences thereof are:

(a) the induced voltage reaches the field deflection circuit and the high voltage thus generated will disturb the operation of this field deflection circuit, (b) the induced voltage produces a current through the field deflection coil via the field deflection circuit so that a rotation of the horizontal lines of the raster with respect to the horizontal axis becomes visible on the display screen. The convergence is also affected (twist errors).

SUMMARY OF THE INVENTION

It is an object of the invention to provide a means which provides correction in a simple manner for the possibility that in a deflection unit the line deflection coils and the field deflection coils may not be arranged exactly at right angles.

According to the invention this is achieved by providing two plate-shaped parts of a soft magnetic material near the front end segments of the two line deflection coils in positions which coincide with two diametrically opposite vertices of a rectangle whose diagonals intersect each other at least substantially on the longitudinal axis of the deflection unit and at which positions a portion of the front end segment of a line deflection coil overlaps a portion of the front end segment of a field deflection coil.

By providing the soft-magnetic plate-shaped parts in the above described manner the field lines are locally bundled in such a manner that the flux through the field deflection coils, and hence the coupling between the field deflection coils and the line deflection coils, is influenced so that the drawback mentioned above under (a) is eliminated and the drawback mentioned under (b) is greatly reduced.

BRIEF DESCRIPTION OF THE DRAWINGS

The invention will now be described in greater detail with reference to the accompanying Figures wherein.

DESCRIPTION OF THE PREFERRED EMBODIMENTS

Figure 1:
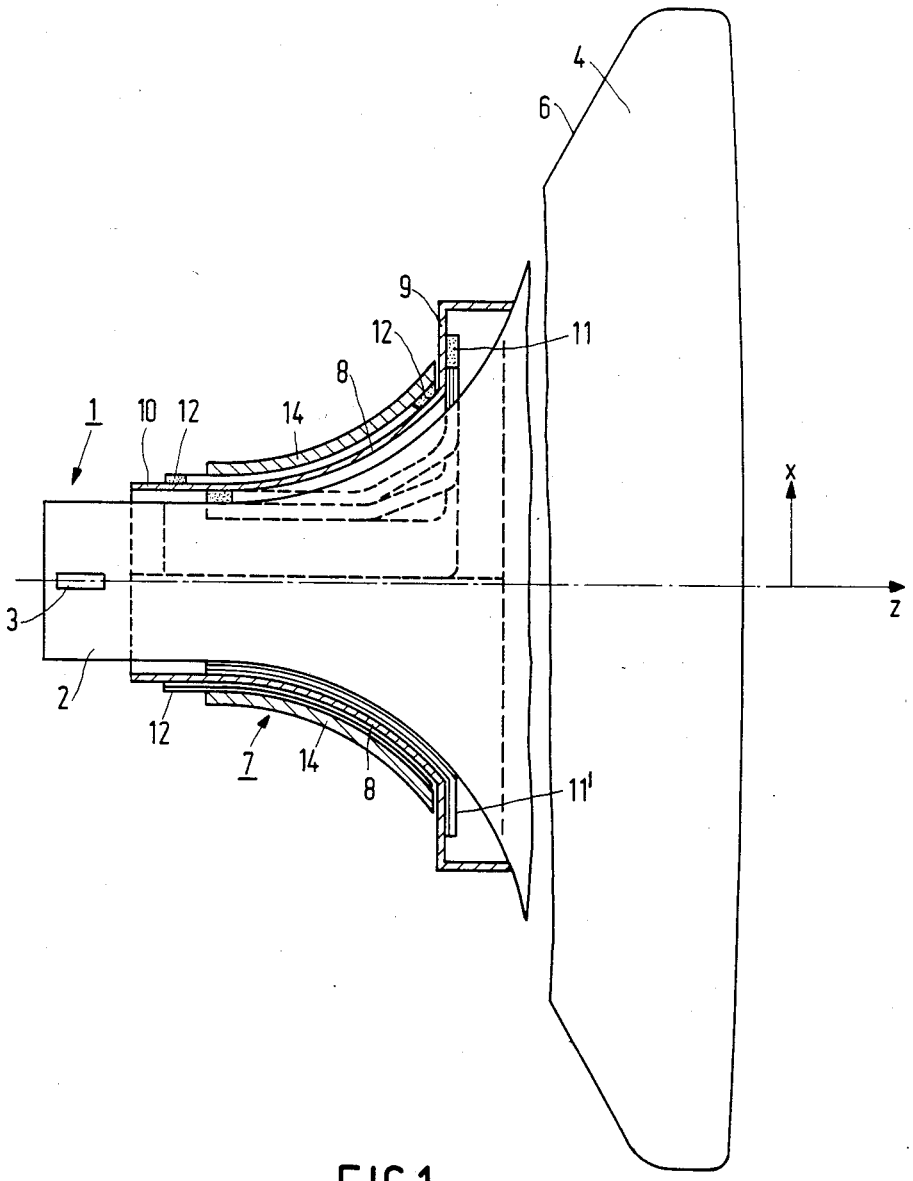
FIG. 1 is a diagrammatic cross-section (taken on the y–z plane) of a cathode ray tube with a deflection unit mounted thereon.

FIG. 1 is a cross-sectional view of a display device comprising a cathode ray tube 1 having an envelope 6 extending from a narrow neck portion 2 in which an electron gun system 3 is mounted to a wide cone-shaped portion 4 which is provided with a display screen. A deflection unit 7 is mounted on the tube at the transition between the narrow and the wide portion. This deflection unit 7 has a support 8 of insulating material with a front end 9 and a rear end 10. Between these ends 9 and 10 there are provided on the inside of the support 8 a system of deflection coils 11, 11' for generating a line deflection magnetic field for deflecting electron beams produced by the electron gun system 3 in the horizontal direction, and on the outside of the support 8 a system of deflection coils 12, 12' for generating a field deflection magnetic field for deflecting electron beams procuced by the electron gun system 3 in the vertical direction. The systems of deflection coils 11, 11' and 12, 12' are surrounded by an annular core 14 of a magnetisable material. The separate coils 12, 12' of the system of field deflection coils, as well as the coils 11, 11' of the system of line deflection coils are of the saddle-type with rear end segments positioned flat against the tube wall. Deflection coils of the saddle type are self-supporting coils comprising a number of conductors which are wound to form longitudinal first and second side packets, an arcuate front end segment and an arcuate rear end segment together defining a window aperture. In such deflection coils the rear end segments may be flared with respect to the profile of the display tube (the original type of saddle coil) or they may be arranged flat against the tube wall (in this type of saddle coil the rear end segments follows, as it were, the tube profile).

Figure 2:
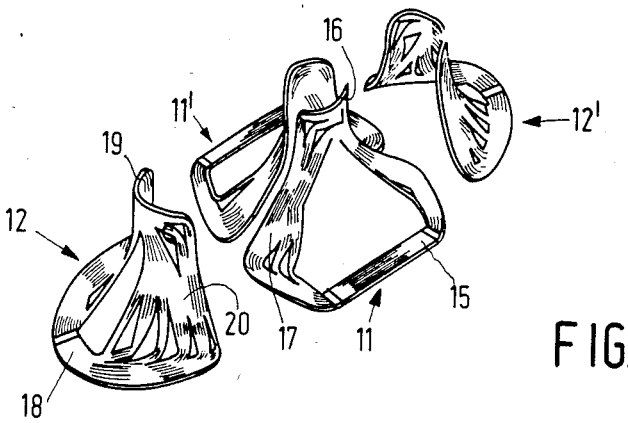
FIG. 2 is a diagrammatic perspective view of the field deflection coils and line deflection coils, shown at a distance from each other, of the deflection unit of the cathode ray tube-deflection unit combination shown in FIG. 1.
Figure 3:
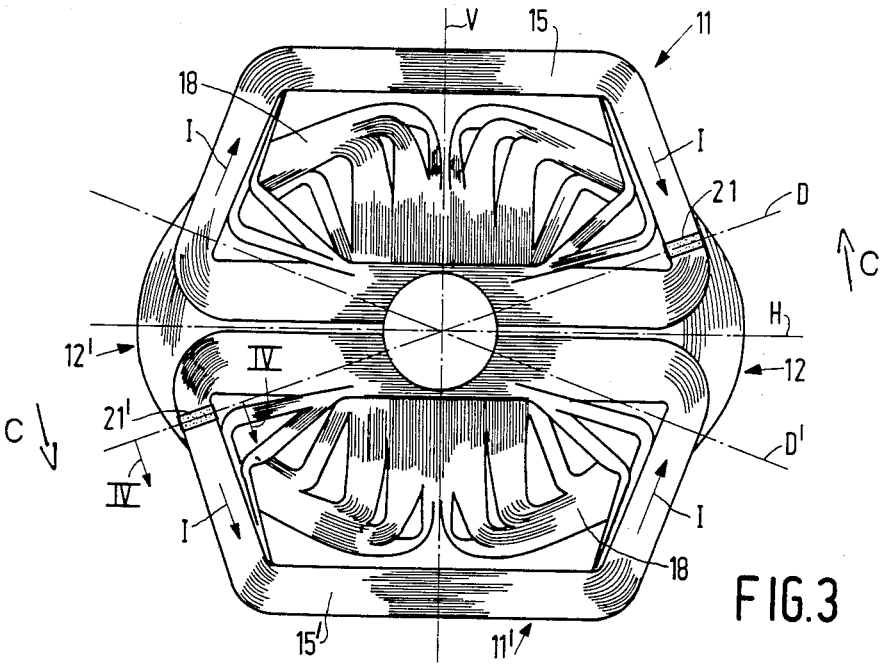
FIG. 3 is a front elevation on a larger scale of a deflection unit consisting of the field deflection coils and line deflection coils.

As has been shown in greater detail in FIGS. 2 and 3, the deflection unit 7 has two line deflection coils 11 and 11' which are diametrically opposite to each other and are arranged on either side of a horizontal axis H, and two field deflection coils 12 and 12' which are located diametrically opposite to each other and are arranged on either side of a vertical axis V extending at right angles to the horizontal axis H.

Each line deflection coil consists of a front end segment 15, a rear end segment 16 and conductors 17 connecting the front end segment 15 and the rear end segment 16. Similarly, a field deflection coil 12 consists of a front end segment 18, a rear end segment 19 and conductors 20 connecting the front end segment 18 and the rear end segment 19.

As explained and shown in the Netherlands patent specification No. 170,573 mentioned in the preamble, the coils constituting the deflection device are arranged in conventional manner around a trumpet-shaped portion of a colour television display tube, which trumpet-shaped portion connects a display screen of the television display tube to a neck portion of the relevant television display tube. The arrangement is such that the longitudinal axis of the deflection unit which is constituted by the coils coincides with the longitudinal axis of the display tube, whilst the front end segments 15 and 18 of the line and field deflection coils are located at the end of the deflection unit facing the display screen.

In the following elaboration the quadrant in FIG. 3 located above the horizontal axis H and to the right of the vertical axis V will be denoted the frist quadrant, the quadrant located below the horizontal axis H and to the right of the vertical axis V will be denoted the second quadrant, the quadrant located below the horizontal axis H and to the left of the vertical axis V will be denoted the third quadrant and the quadrant located above the horizontal axis H and to the left of the vertical axis V will be denoted the fourth quadrant.

Assuming that the current flows through the line deflection coils as is indicated by the arrows I and the line and field deflection coils are arranged exactly at right angles to each other, line deflection flux will enter the first quadrant in the field deflection coil, which flux is equal to the line deflection flux leaving the field deflection coil in the second quadrant, so that the net line deflection flux in the field deflection coil is equal to zero in this case. The same applies to the line deflection coil located in the third and fourth quadrants.

If, however the symmetry plane of the two line deflection coils 11, 11' has been slightly rotated clockwise with respect to the horizontal axis H (for example, as a result of manufacturing tolerances or the like) the line flux entering the field deflection coil 12 in the first quadrant will slightly decrease and the flux leaving the second quadrant will slightly increase, so that there is a net line deflection flux leaving the field deflection coil 12. Correspondingly, a net line deflection flux is obtained entering the field deflection coil 12' located in the third and fourth quadrants.

Figure 5:
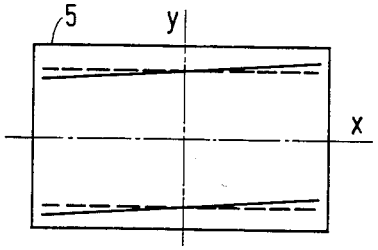
FIG. 5 is an elevational view of the display screen of the cathode ray tube of FIG. 1, showing a rotation to be corrected by means of the invention of the horizontal lines of the raster relative to the horizontal axis X.

The (unwanted) result is that the horizontal lines of the raster present a rotation with respect to the horizontal (x) axis on the display screen 5 as shown in FIG. 5.

Figure 4:
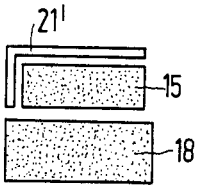
FIG. 4 is a diagrammatic cross-sectional view of the conductors taken on the line IV—IV in FIG. 3 showing the arrangement of a plate-shaped part with respect to the conductors.

In order to counteract this effect, plate-shaped parts 21, 21' manufactured from a soft magnetic material are provided near the transition of the front end segments 15 into the conductors 17, on diagonal D which extends through the longitudinal axis of the deflection unit and across those ends of the front end segments 15 of the line deflection coils 11, 11' which are located furthest away from the horizontal axis H as a result of the rotation in the direction of the arrows C. Such plate-shaped parts, as shown in FIG. 4, may have a L-shaped structure and whose long limbs extend along the a portion of the front end segments 15 of the line deflection coils which overlaps a portion of the front end segments 18 of the field deflection coils. The length of these limbs corresponds with the width of the front end segment 15 at this region. The short limbs of the L-shaped plate-shaped parts extends over the edge of the relevant front end segments of the line deflection coils towards the front end segment 18 of the field deflection coil.

By providing these plate-shaped parts or field conductors manufactured from a soft magnetic material, the line deflection flux entering the field deflection coil is intensified in the first quadrant and the line deflection flux leaving the field deflection coil in the third quadrant is intensified, so that the above described effect caused by the rotation of the line deflection coils in the direction of the arrows C is counteracted.

It will be evident from the foregoing that in the case of a rotation of the symmetry plane of the line deflection coils in an anti-clockwise direction relative to the horizontal axis the plate-shaped parts have to be provided on the line deflection coils at two diametrically opposite points located on the diagonal D'.

A rotation of the line deflection coils with respect to their desired position is mentioned above as an example. However, the field deflection coils may deviate from their symmetrical location, or both the line deflection coils and the field deflection coils may have a deviating location. In all these cases the present invention provides a correction by arranging two plate-shaped soft magnetic parts near the front end segments of the two line deflection coils in positions which coincide with two diametrically opposite vertices of a rectangle whose diagonals intersect each other at least substantially on the longitudinal axis of the deflection unit and in which positions a portion of a front end segment of a line deflection coil overlaps a portion of the front end segments of a field deflection coil. And in all these cases the explanation given for their operation remains valid.

In one embodiment parts 21, 21' were manufactured from an Si Fe alloy having a thickness of 0.35 mm and a width of 3 mm, which in a deflection unit as described in the article mentioned in the preamble resulted in a coupling influence of 9 mV at a voltage of 1 V across the line deflection coils.

The influence of spreading, if not corrected, is, for example, 6 mV in the case of an incorrect arrangement, which results in a total range of between −18 mV and +18 mV.

In this case this will be reduced to ±9 mV by using the correction means according to the invention.

In practice the position of the correction means (the plates 21, 21'), and hence the choice of the correct diagonal, can be determined by measuring the phase of the voltage produced across the field deflection coil with respect to the voltage applied across the line deflection coil.

I claim:

1. An improved deflection unit for a cathode ray tube having a longitudinal axis, a neck portion at one end of such axis and a display screen at the other end thereof, and a flared portion connecting the neck portion with the display screen; such deflection unit being adapted to be arranged around said flared portion concentrically with said longitudinal axis and comprising a field coil system and a line coil system for deflecting an electron beam in said tube in mutually orthogonal directions; the field coil system comprising a pair of diametrically opposite saddle-type field deflection coils located on either side of a vertical axis of said deflection unit and the line deflection coil system comprising a pair of diametrically opposite saddle-type line deflection coils located on either side of a horizontal axis of said deflection unit; each of said coils having a front end segment, a rear end segment and conductors extending between such segments; such improvement being characterized in that: said deflection unit comprises a pair of plate-shaped parts of soft magnetic material respectively extending across the front end segment of respective ones of said pair of line deflection coils in positions coinciding with diametrically opposite vertices of a rectangle whose diagonals intersect substantially on the longitudinal axis of the deflection unit, and at each of which positions a portion of a front end segment of a line deflection coil overlaps a portion of a front end segment of a field deflection coil.

2. A deflection unit as claimed in claim 1, characterized in that the plate-shaped parts have a width of approximately 3 mm, a length which is substantially equal to the width of the front end segment of the line deflection coil, and a thickness of less than 0.5 mm.

* * * * *